US010932038B2

(12) United States Patent
Zheng et al.

(10) Patent No.: US 10,932,038 B2
(45) Date of Patent: Feb. 23, 2021

(54) SPEAKER BOX

(71) Applicant: AAC Acoustic Technologies (Shenzhen) Co., Ltd., Shenzhen (CN)

(72) Inventors: Yajian Zheng, Shenzhen (CN); Lu Feng, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/686,236

(22) Filed: Nov. 18, 2019

(65) Prior Publication Data

US 2020/0162811 A1 May 21, 2020

(30) Foreign Application Priority Data

Nov. 19, 2018 (CN) ..... 201821897269.4

(51) Int. Cl.
*H04R 1/34* (2006.01)
*H04R 7/12* (2006.01)
*H04R 1/02* (2006.01)

(52) U.S. Cl.
CPC ..... *H04R 1/345* (2013.01); *H04R 1/025* (2013.01); *H04R 7/12* (2013.01); *H04R 2499/11* (2013.01)

(58) Field of Classification Search
CPC ..... H04R 1/02; H04R 1/025; H04R 1/2083; H04R 1/2807; H04R 1/2811; H04R 1/2815; H04R 1/2819; H04R 1/2823; H04R 1/2826; H04R 1/2834; H04R 1/28345; H04R 1/2842; H04R 7/12; H04R 7/16; H04R 2499/11
USPC ..... 381/334, 335, 337, 338, 339, 345, 350, 381/351
See application file for complete search history.

(56) References Cited

U.S. PATENT DOCUMENTS 5,189,706 A * 2/1993 Saeki ..... H04R 1/2826 181/155
5,471,019 A * 11/1995 Maire ..... H04R 1/2842 181/156
6,002,949 A * 12/1999 Hawker ..... H04M 1/0202 361/814
6,621,910 B1 * 9/2003 Weckstrom ..... H04M 1/03 381/346
7,136,498 B1 * 11/2006 Schott ..... H04R 1/2842 381/351
9,241,207 B2 * 1/2016 Wang ..... H04R 1/2842
9,781,238 B2 * 10/2017 Schoerkmaier ..... H04M 1/035
9,838,765 B1 * 12/2017 Li ..... H04R 1/288
(Continued)

*Primary Examiner* — Xu Mei
(74) *Attorney, Agent, or Firm* — W&G Law Group LLP

(57) ABSTRACT

The present invention provides a speaker box, includes a housing having an accommodating space, a speaker unit accommodated in the accommodating space of the housing, and a sound channel formed in the accommodating space. The speaker unit includes a diaphragm that vibrates sound. The diaphragm divides the accommodating space into a front sound cavity and a rear cavity. The sound channel communicates the front sound cavity with an outside and is connected with the front sound cavity to form a front cavity. The sound channel includes a first sound channel communicating the front sound cavity with the outside and two second sound channels communicating with the front sound cavity and the first sound channel. The second sound channels are respectively disposed at opposite sides of the first sound channel.

4 Claims, 4 Drawing Sheets

(56) References Cited

U.S. PATENT DOCUMENTS

| | | | | |
|---|---|---|---|---|
| 10,412,484 | B2 * | 9/2019 | Je | H04R 1/345 |
| 2007/0297629 | A1 * | 12/2007 | Gelbart | H04R 1/345<br>381/351 |

* cited by examiner

A-A

B-B

SPEAKER BOX

TECHNICAL FIELD

The present disclosure relates to an electroacoustic field, and in particular to a speaker box for portable electronic products.

BACKGROUND

With the advent of mobile internet era, the amount of smart mobile devices continues to rise. Among many mobile devices, mobile phones are undoubtedly the most common and portable mobile terminal devices. At present, functions of the mobile phones are extremely diverse, one of which is high-quality music functions, thus, a speaker box for playing sound is widely used in today's smart mobile devices.

The speaker box in the prior art comprises a housing having an accommodating space, a speaker unit accommodated in the housing, and a sound channel formed in the accommodating space. The speaker unit comprises a diaphragm that vibrates for generating sound. The diaphragm divides the accommodating space into a front sound cavity and a rear cavity. The sound channel communicates the front sound cavity with an outside. The sound channel communicates with the front sound cavity to form a front cavity.

However, in the prior art, the sound channel of the speaker box is designed to be single, and a structure for emitting sound is formed on one side of the speaker unit. Since airflow of the front sound cavity needs to enter the sound channel from the same side of the speaker unit, airflow in the front cavity is easily unbalanced, which cause the swing amplitude of the diaphragm to be excessive during vibration, which affects reliability and acoustic performance of the speaker box.

Therefore, it is necessary to provide a speaker box to solve above technical problems.

BRIEF DESCRIPTION OF DRAWINGS

In order to more clearly illustrate technical solution in embodiment of the present disclosure, the drawings used in the description of the embodiment will be briefly described below. Apparently, the drawings in the following description are merely some of the embodiment of the present disclosure, and those skilled in the art are able to obtain other drawings according to the drawings without contributing any inventive labor. In the drawing.

DETAILED DESCRIPTION OF THE EXEMPLARY EMBODIMENT

The technical solutions in the embodiments of the present disclosure will be clearly and completely described in conjunction with the drawings in the embodiments of the present disclosure. It is obvious that the described embodiments are only a part of the embodiments of the present disclosure, and not all of them. All other embodiments obtained by those skilled in the art based on the embodiments of the present disclosure without creative efforts are within the scope of the present disclosure.

Figure 1:
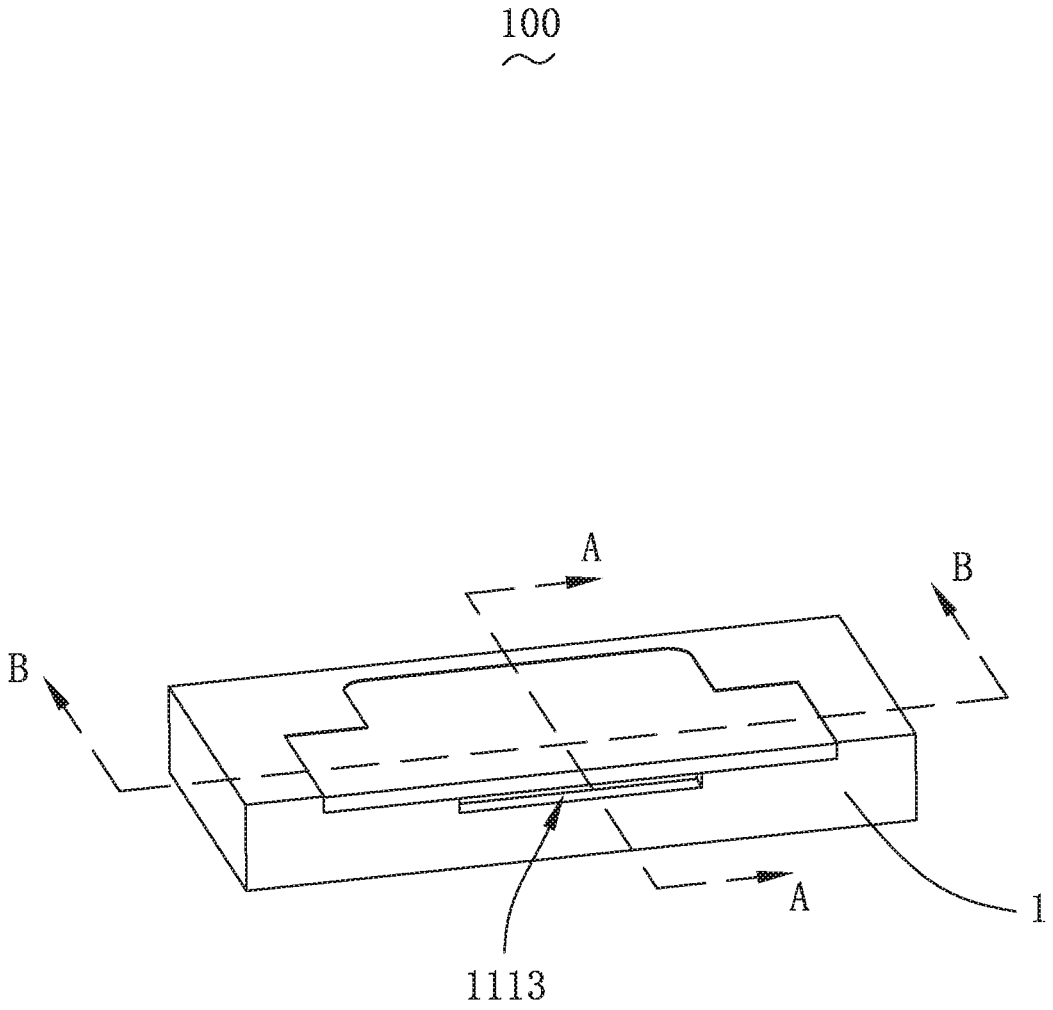
FIG. 1 is a schematic perspective view of a speaker box according to the present disclosure.
Figure 2:
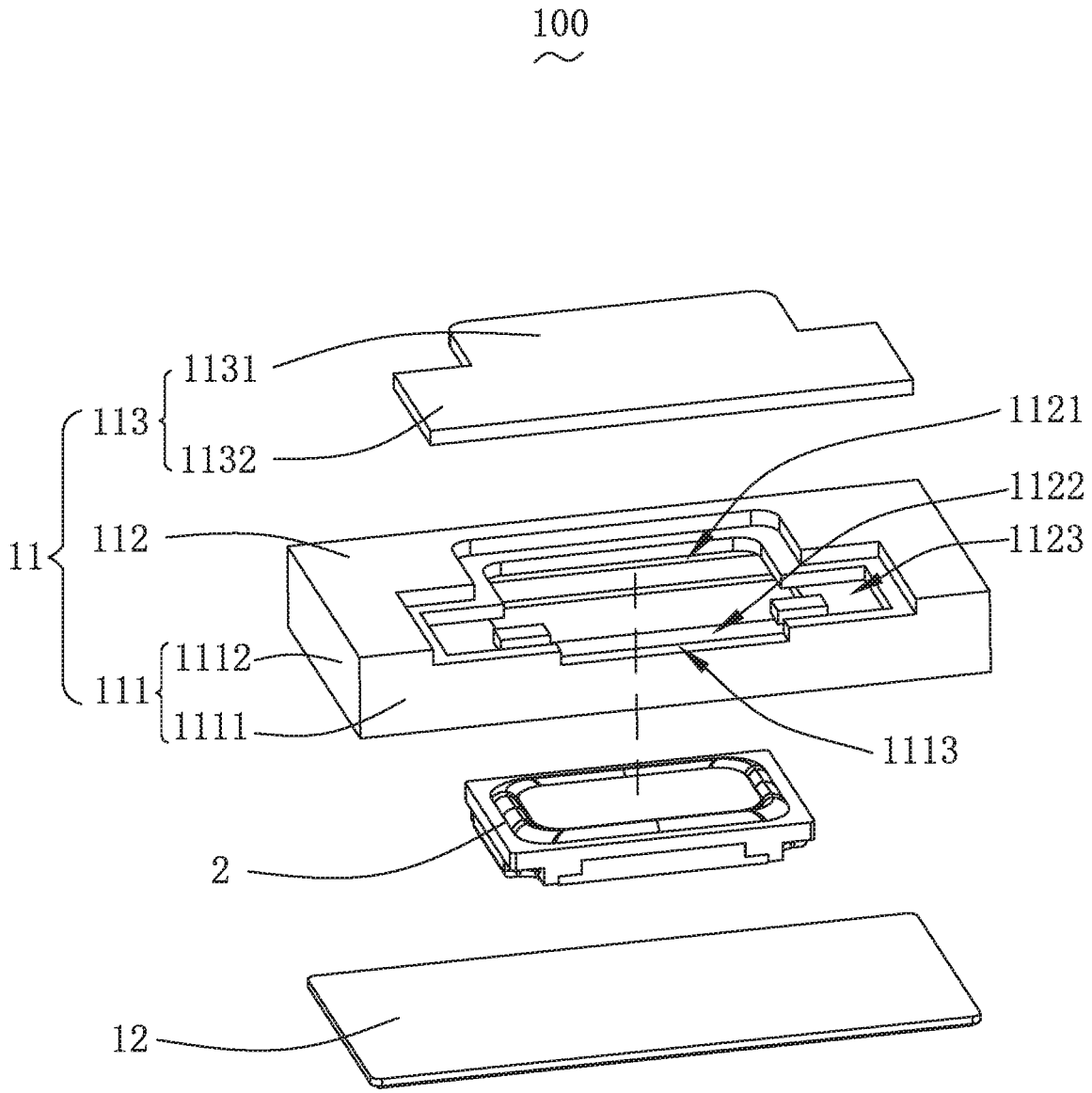
FIG. 2 is an exploded perspective view showing a portion of the speaker box of the present disclosure.
Figure 3:
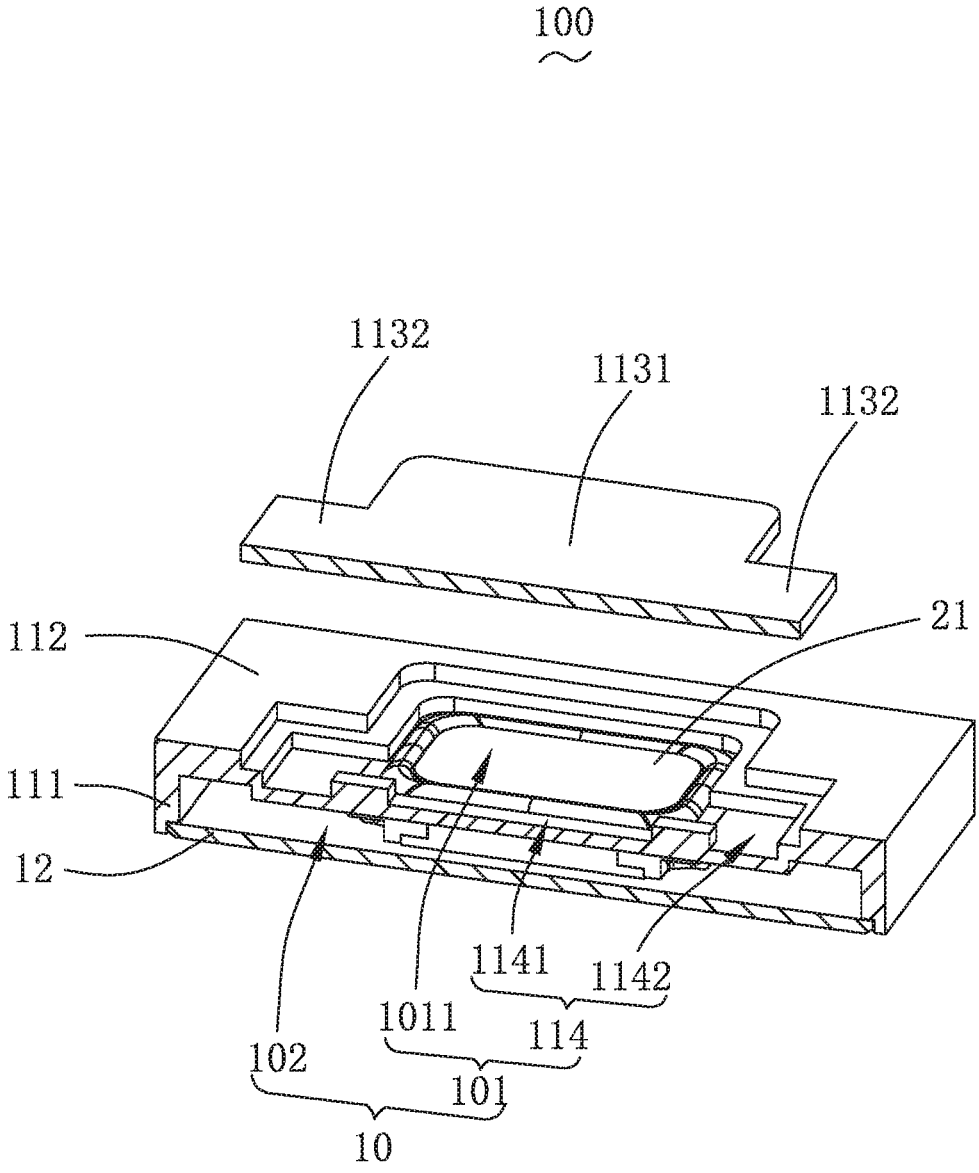
FIG. 3 is a cross-sectional view of the speaker box of the present disclosure.
Figure 4:
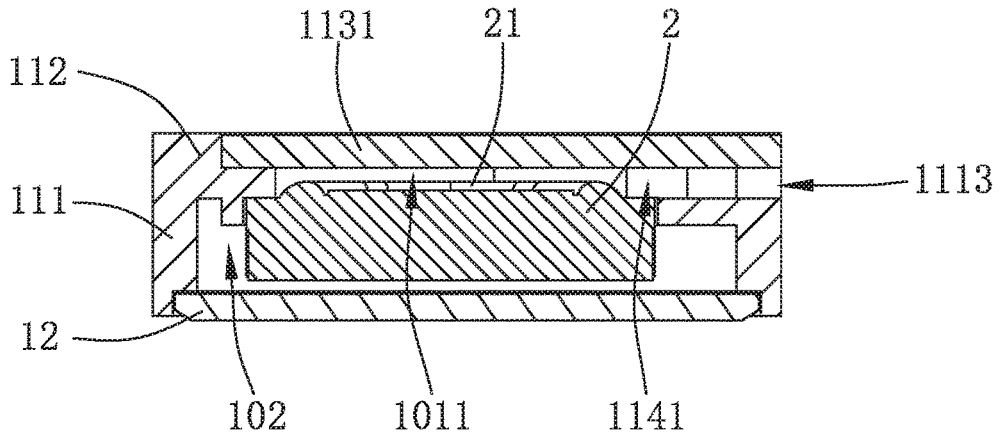
FIG. 4 is a cross-sectional view taken along a line A-A shown in FIG. 1.
Figure 5:
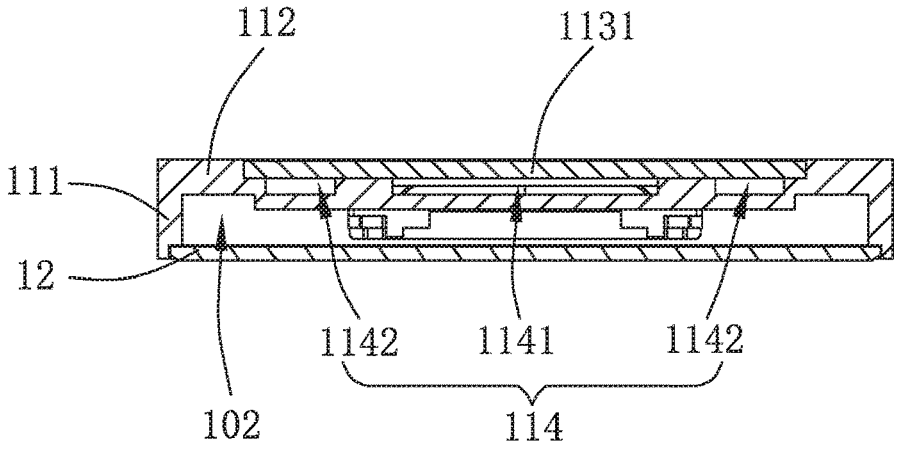
FIG. 5 is a cross-sectional view taken along a line B-B shown in FIG. 1.

As shown in FIGS. 1-2, the present disclosure provides a speaker box 100. The speaker box 100 includes a housing 1 and a speaker unit 2.

As shown in FIGS. 2-5, the housing 1 has an accommodating space 10. The housing 1 may be integrally formed as one part or assembled with separate parts. In the embodiment, the housing 1 is assembled with separate parts. Specifically, the housing 1 comprises an upper cover 11, a lower cover 12 covered on the upper cover 11 to form the accommodating space 10.

The upper cover 11 comprises an annular side wall 111, a bottom plate 112 connected with the side wall 111, and an upper cover plate 113. The upper cover plate 113 is covered on the bottom plate 112 and is far away from the lower cover 12.

Furthermore, the speaker box 100 is of a rectangular shape. The side wall 111 comprises two long side walls 1111 parallel to a long axis and two short side walls 1112 parallel to a short axis. The two long side walls 1111 are disposed opposite to each other; the two short side walls 1112 are disposed opposite to each other. Of course, the shape of the speaker box is not limited to this.

The speaker unit 2 is received in the accommodating space 10 of the housing 1. The speaker unit 2 divides the accommodating space 10 into a front sound cavity 1011 and a rear cavity 102. A sound channel 114 communicating the front sound cavity 1011 with an outside is formed in the accommodating space 10.

Specifically, the speaker unit 2 comprises a diaphragm 21 that vibrates for generating sound. The diaphragm 21 divides the accommodating space 10 into the front sound cavity 1011 and a rear cavity 102.

In the embodiment, the lower cover 12 is fixedly covered on the side wall 111 and spaced apart from the bottom plate 112. The lower cover 12, the side wall 111, the bottom plate 112, and the speaker unit 2 are enclosed together to form the rear cavity 102. The rear cavity 102 is configured for improving low frequency acoustic performance of the speaker box 100.

Furthermore, the bottom plate 112 comprises an accommodating hole 1121. The accommodating hole 1121 is a through hole penetrating through the bottom plate 112. The speaker unit 2 is clamped and fixed in the accommodation hole 1121. And the speaker unit 2 makes an interval between the diaphragm 21 and the upper cover plate 113 to form the front sound cavity 1011. The sound channel 114 communicates the front sound cavity 1011 with the outside, and the sound channel 114 is connected with the front sound cavity 1011 to form a front cavity 101. The front cavity 101 forms a side sounding structure.

The sound channel 114 comprises a first sound channel 1141 and two second sound channels 1142. The first sound channel 1141 communicates the front sound cavity 1011 with the outside. The second sound channels 1142 communicate with the front sound cavity 1011 and the first sound channel 1141. And the second sound channels 1142 are respectively disposed at opposite sides of the first sound channel 1141.

In the embodiment, a side of the bottom plate 112 close to the upper cover plate 113 is dimpled to form a first accommodating groove 1122 and two second accommodating grooves 1123. The first accommodating groove 1122 communicates with the accommodating hole 1121 and is disposed at one side of the accommodating hole 1121. The two second accommodating grooves 1123 communicates with the accommodating hole 1121 and is respectively disposed at another two opposite sides of the accommodating hole 1121. The upper cover plate 113 and the first accommodating groove 1122 are enclosed together to form the first sound channel 1141. The upper cover plate 113 is enclosed together with the second accommodating grooves 1123 to form the two second sound channels 1142.

Furthermore, a sound hole 1113 is disposed in the side wall 111, and the sound hole penetrates through the side wall 111. To be specific, the sound hole 1113 is disposed at one of the long side walls 1111. The first sound channel 1141 is in airflow communication with the outside through the sound hole 1113.

Furthermore, the upper cover plate 113 comprises a main body portion 1131 and two extending portions 1132. The main body portion 1131 is close to the sound hole 1113. Two opposite sides of the main body portion 1131 extends along a direction away from the main body portion 1131 to form the two extending portions 1132. The main body portion 1131 faces the diaphragm 21 with space to form the front sound cavity 1011. The main body portion 1131 and the first accommodating groove 1122 are enclosed together to form the first sound channel 1141. The two extending portions 1132 are respectively enclosed together with the two second accommodating grooves 1123 to form the two second sound channels 1142.

The first sound channel 1141 directly communicates with the outside as a main sound channel, and the two second sound channels 1142 respectively communicate with the front sound cavity 1011 and the first sound channel 1141, which are served as auxiliary sound channels. Part of sound in the front sound cavity 1011 is directly emitted to the outside through the first sound channel 1141 (main sound channel). Another part of the sound is first transmitted to the two second sound channels 1142 (auxiliary sound channels), and then transmitted from the two second sound channels 1142 (auxiliary sound channels) to the first sound channel 1141 (main sound channel) to the outside. Thereby, the side sounding structure combining the main sound channel and the auxiliary sound channel is realized.

In above structure, the two second sound channels 1142 are symmetrically disposed at opposite sides of the first sound channel 1141, so that airflow in the front cavity 101 is well balanced, an amplitude of oscillation of the diaphragm 21 during a vibration process is effectively suppressed, thus, reliability of the speaker box 100 is high. In addition, arrangement of the two second sound channels 1142 increases an effective conductive space volume of the sound channel 114, so that sounding airflow of the front sound cavity 1011 is smoother, and soundness of the front cavity 101 is improved, thereby making an acoustic performance of the speaker box 100 superior.

Compared with the prior art, in the speaker box of the present disclosure, the sound channel comprises the first sound channel communicating the front sound cavity with the outside and second sound channels communicated with the front sound cavity and the first sound channel. The first sound channel is configured as the main sound channel, and the two second sound channels are configured as auxiliary sounding emitting channels. The first sound channel (main sound channel) is disposed in cooperation with the two second sound channels (auxiliary sound channels), which forms the side sounding structure combining the main sound channel and the auxiliary sound channel. In the above structure, the two second sound channels are symmetrically disposed at two opposite sides of the first sound channel, so that airflow in the front cavity is well balanced, the amplitude of the oscillation of the diaphragm during the vibration process is effectively suppressed, thus, the reliability of the speaker box is high. In addition, the arrangement of the two second sound channels increases the effective conductive space volume of the sound channel, so that the sounding airflow of the front sound cavity is smoother, and soundness of the front cavity is improved, thereby making the acoustic performance of the speaker box superior.

The above is only the embodiments of the present disclosure, and it should be noted that those skilled in the art can make improvements without departing from the concept of the present disclosure, which are all within the scope of the present disclosure.

What is claimed is:

1. A speaker box, comprising:

a housing having an accommodating space, a speaker unit accommodated in the accommodating space of the housing, and a sound channel formed in the accommodating space; wherein, the speaker unit comprises a diaphragm that vibrates for generating sound; the diaphragm dividing the accommodating space into a front sound cavity and a rear cavity; the sound channel communicates the front sound cavity with an outside; the sound channel and the front sound cavity cooperatively form a front cavity; and the sound channel comprises a first sound channel and two second sound channels; the two second sound channels and the first sound channel communicate the front sound cavity with the outside; the two second sound channels communicate with the front sound cavity and the first sound channel; and the two second sound channels are respectively disposed at opposite sides of the first sound channel;

wherein the housing comprises an upper cover, a lower cover covered on the upper cover to cooperatively form the accommodating space with the upper cover;

the upper cover comprises an annular side wall, a bottom plate connected with the side wall, and a upper cover plate;

the upper cover plate is covered on the bottom plate and far away from the lower cover;

the bottom plate comprises an accommodating hole, a first accommodating groove, and two accommodating grooves; the accommodating hole penetrates through the bottom plate; a side of the bottom plate close to the upper cover plate is dimpled to form the first accommodating groove and the two second accommodating grooves; the first accommodating groove communicates with the accommodating hole and is disposed at a side of the accommodating hole, the two second accommodating grooves with the accommodating hole and are respectively disposed at another opposite sides of the accommodating hole;

the speaker unit is clamped and fixed in the accommodation hole, and an interval is formed between the diaphragm and the upper cover plate to form the front sound cavity;

the upper cover plate and the first accommodating groove are enclosed together to form the first sound channel, the upper cover plate is enclosed together with the second accommodating grooves to form the two second sound channels;

the lower cover, the side wall, the bottom plate, and the speaker unit are enclosed together to form the rear cavity.

2. The speaker box according to the claim 1 further comprises a sound hole disposed in the side wall and penetrating through the side wall; the first sound channel communicating with the sound hole.

3. The speaker box according to the claim 2, wherein the upper cover plate comprises a main body portion and two extending portions;

the main body portion is close to the sound hole;

each of the extending portions extends from a side of the main body portion along a direction away from the main body portion; two extending portions opposite to each other;

the main body portion facing the diaphragm with space to form the front sound cavity;

the main body portion and the first accommodating groove enclosed together to form the first sound channel;

each of the two extending portions enclosed together with the corresponding second accommodating groove to form the second sound channel.

4. The speaker box according to the claim 3, wherein the speaker box is of a rectangular shape, the side wall comprises two long side walls parallel to a long axis and two short side walls parallel to a short axis; the two long side walls are disposed opposite to each other; the two short side walls are disposed opposite to each other; the sound hole is disposed in one of the long side walls.

* * * * *